United States Patent [19]

Coxon

[11] Patent Number: 4,500,077

[45] Date of Patent: Feb. 19, 1985

[54] DEVICE FOR CLAMPING WORKPIECES

[76] Inventor: John R. Coxon, Penfound, Stane St., Pulborough, Sussex, England

[21] Appl. No.: 514,095

[22] Filed: Jul. 15, 1983

[30] Foreign Application Priority Data

Jul. 16, 1982 [GB] United Kingdom ..... 8220736

[51] Int. Cl.[3] ..... B25B 1/22

[52] U.S. Cl. ..... 269/45; 269/77; 269/82

[58] Field of Search ..... 269/45, 78, 82–84, 269/75, 328; 403/55, 389, 390, 391, 385; 248/122, 124, 274, 276, 278, 288.5, 160, 480, 291

[56] References Cited

U.S. PATENT DOCUMENTS 1,670,253 5/1928 Gilbert et al. .
2,669,958 2/1954 Sweeney .
3,103,352 9/1963 Steffen .
4,392,645 7/1983 Westphal .
4,402,481 9/1983 Susaki .
4,426,071 1/1984 Klevstad .

FOREIGN PATENT DOCUMENTS 1600197 10/1981 United Kingdom .
2034235 12/1982 United Kingdom .

*Primary Examiner*—Robert C. Watson
*Attorney, Agent, or Firm*—Finnegan, Henderson, Farabow, Garrett & Dunner

[57] ABSTRACT

A device for supporting a workpiece 5 from a bench 4 in any required spatial position comprises two G-clamps 1 which are adjustably fixed to a metal tube 2 by clamping devices 3. Each of the devices 3 is operated by a single clamping screw having a handle 21 and when the clamping screw has been released, the device 3 can slide along, and turn about the axis of, the tube 2. Also, the clamp 1 can turn relative to the clamping device 3 about the axis of the clamping screw and about the axis of a pin 24 which is perpendicular to the axis of the clamping screw. This enables the workpiece 5 to be set in almost any desired position and orientation relative to the bench 4 and, when set, to be locked in its set position by tightening the two clamping screws by means of their handles 21. The device is therefore extremely versatile and it can, of course, alternatively be used to hold two workpieces in position relative to each other, for example while glued joints set.

7 Claims, 3 Drawing Figures

DEVICE FOR CLAMPING WORKPIECES

When a workpiece has to be held in a fixed position to enable an operation to be carried out upon it, it is common to hold the workpiece in a vice which is itself fixed to a workbench or other rigid support. Although some vices have their jaws mounted so that they can rotate about an upright axis which is perpendicular to the line along which the jaws open and close, the positions in which a workpiece can be held by a vice are very limited.

When two workpieces have to be held against each other, a vice, or G-clamp is generally used, but again there is very little flexibility in the positions in which the workpieces can be held relative to each other.

When repetitive operations are to be carried out on a series of workpieces, it may be economic to provide a purpose-made jig to hold a workpiece, or two workpieces in any particular spatial or relative positions which are required. Such jigs are not, however, economic for carrying out one-off operations and accordingly the need exists, particularly in the "do-it-yourself" field of activity, for a device which is capable of holding two workpieces in relative positions which can easily be varied, or holding a single workpiece from a support in a spatial position which can be varied.

According to this invention, a device for performing these functions comprises two workpiece clamps, each of which is arranged to hold a workpiece, or to be fixed to a support, and each of which is attached to an elongate cylindrical member by a clamping device which allows the workpiece clamp to be adjusted in position along a longitudinal axis of the elongate member; to be adjusted in angular position around the said longitudinal axis and also to be adjusted in angular position about a second axis, which is perpendicular to the said longitudinal axis, and about a third axis, which is perpendicular to the second axis, wherein each of the clamping devices by which the workpiece clamps are attached to the elongate member or members is operated by a single clamping screw and comprises two plates arranged face to face with registering grooves in which the elongate member is held, and a body member which is attached to the workpiece clamp by pivot means, the clamping screw passing through the plates and through the body member to the pivot means and being arranged so that, when tightened, it clamps the plates together with the elongate member between them and also clamps the two plates to the body member and clamps the pivot means against movement, and, when loosened, allows the plates to turn relative to the elongate member about the axis of the elongate member; allows the plates to turn relative to the body member about the axis of the clamping screw, which forms the second axis; and frees the pivot means to allow the workpiece clamp to pivot relative to the body member about an axis, which form the third axis, perpendicular to the axis of the clamping screw.

The two workpiece clamps may be attached to the same elongate member, which is preferably in the form of a cylindrical tube to provide a satisfactory stiffness/-weight ratio and it has been found that using a single elongate member in this way generally provides adequate adjustability of the relative positions of the two workpieces, or of the spatial position of a single workpiece fixed to a support, for most practical purposes. However, as an alternative, two workpiece clamps may be attached at or near one end of each two separate elongate cylindrical members, and a further clamping device is then provided which fixes the two elongate members together in relative positions which can be varied along the lengths of both elongate members and can also be varied angularly about two perpendicular axes. This latter arrangement provides almost total adjustability in the positions and orientations in which the workpiece or workpieces can be fixed, but it is somewhat more complex and therefore more expensive and less rigid than the arrangement in which both the workpiece clamps are attached to the same elongate member.

Whether there is only one, or there are two elongate members, one workpiece clamp may be clamped to a workbench or other fixed support and the other clamp may be clamped to a workpiece which can then, by adjusting either the two clamping devices, or the three clamping devices when there are two elongate members, be set in a wide variety of positions and orientations, the positions, when there are two elongate members, being limited only by the lengths of the members.

Alternatively, where two workpieces are to be held in particular relative positions, for example if two pieces of timber are to be held while glue in a joint between them is hardening, one of the two workpiece clamps of the device is fixed to each of the workpieces and again the clamping devices are freed and then tightened again after the workpieces have been set in the required positions.

The clamping screw may be screwed into a tapped bore, or be provided with a nut. In the first case, the clamping screw itself is preferably provided with a handle and in the second case, the nut is preferably a wing nut .

The pivot means allows the workpiece clamp to pivot relative to the body member about the third axis preferably comprises a tubular portion of the workpiece clamp, and a cylindrical piece which fits, and is rotatable, in the bore of the tubular portion. The tubular portion has an arcuate slot through which the clamping screw passes and the cylindrical piece has a tapped diametric bore into which the clamping screw is screwed.

Two examples of devices in accordance with the invention will now be described with reference to the accompanying drawings in which.

Figure 1:
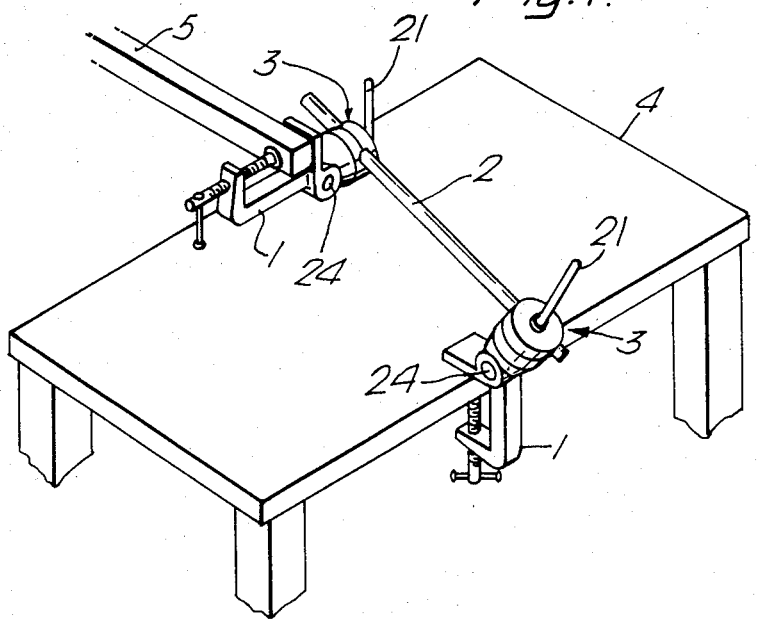
FIG. 1 is a somewhat diagrammatic perspective view of one example of the device shown in use holding a workpiece in position from a workbench.

The first example shown in FIG. 1 of the drawings comprises two workpiece clamps 1, each of which if adjustably fixed to an elongate member in the form of a tube 2 by a clamping device 3. One of the clamps 1 is clamped to a workbench 4 and the other of the clamps 1 holds a workpiece 5.

Figure 2:
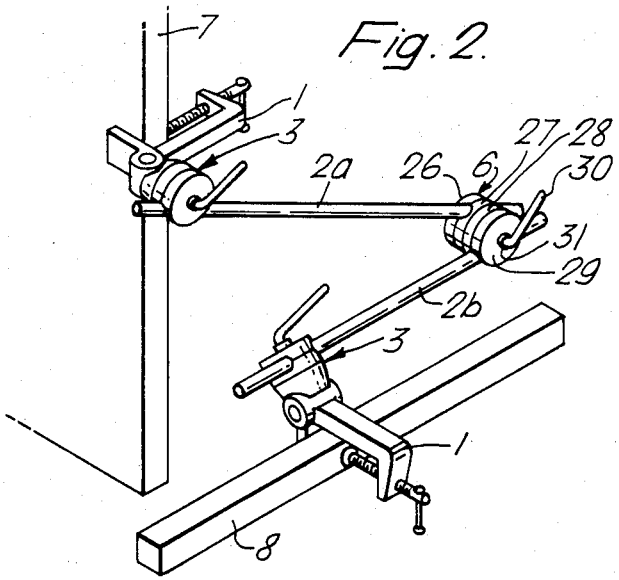
FIG. 2 is a similar view of a second example of the device shown in use in supporting a workpiece from a fixed support; and, FIG. 3 is a side view to a larger scale of one of the two workpiece clamps and one of the two clamping devices which form part of both of the examples illustrated in FIGS. 1 and 2.

In the second example shown in FIG. 2, the device comprises two workpiece clamps 1 with clamping devices 3, which are the same as the clamps and clamping devices 1 and 3 in the first example, but instead of the clamping devices 3 both being attached to the same tube 2, they are attached to two separate tubes 2*a* and 2*b*.

The tubes 2*a* and 2*b* are themselves adjustably clamped together by a further clamping device 6.

In this example, one of the clamps 1 holds a door 7 and the other clamp 1 is clamped to a fixed support 8. In this way the door 7, by adjusting the clamping devices 3 and 6, can be accurately set and held in position while it is hung.

Figure 3:
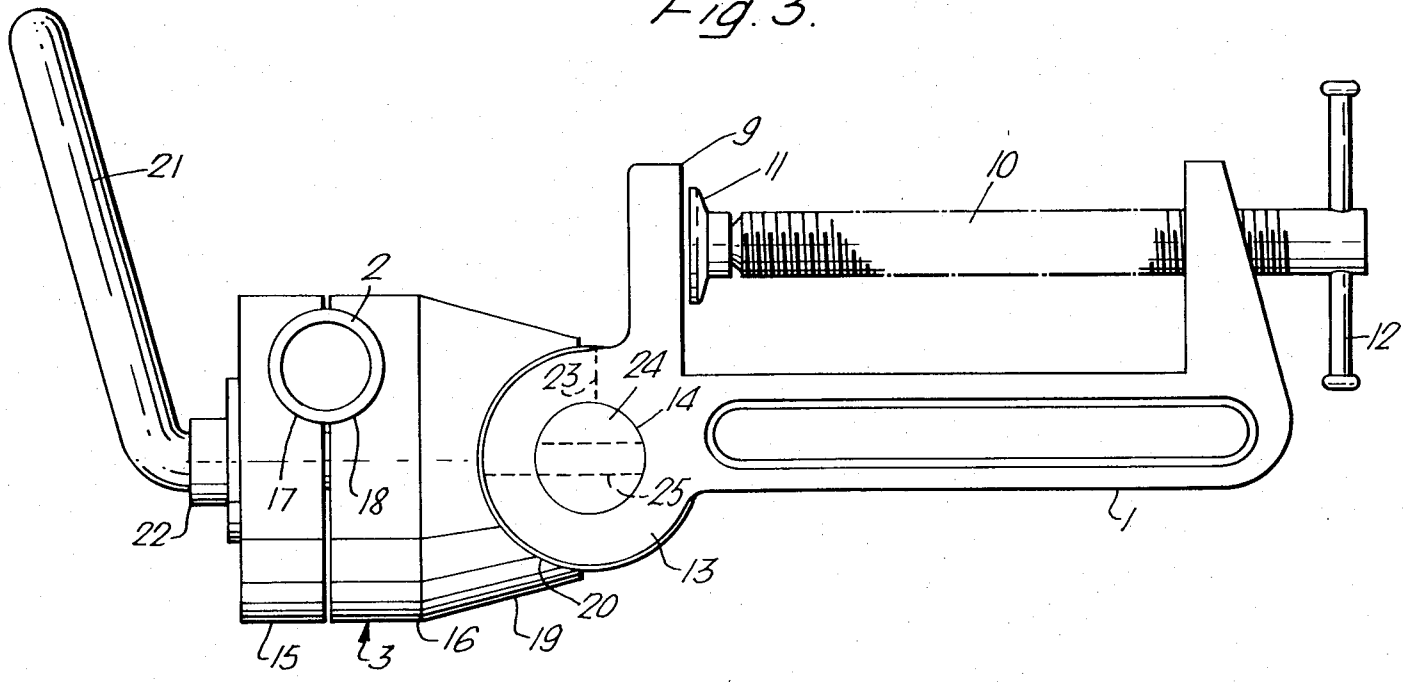

The clamps 1 and the clamping devices 3 are shown in detail in FIG. 3 and from this Figure of the drawings it will be seen that the workpiece clamp 1 is in the form of a G-clamp with a clamping jaw 9 and a clamping screw 10 with a clamping pad 11 at its end. The clamping screw 10 is turned by a tommy bar 12.

The clamp 1 has, adjacent the jaw 9, a projecting part-cylindrical lug 13 having a bore 14 extending through it with its axis perpendicular to that of the clamping screw 10.

The clamping device 3 by which the clamp 1 is attached to the tube 2, which is cylindrical, comprises two circular disc-like plates 15 and 16 provided with registering grooves 17 and 18 of part-circular cross-section. The tube 2 fits in the grooves 17 and 18 and as the depths of the grooves 17 and 18 are slightly less than the radius of the tube 2, the plates 15 and 16 are held slightly spaced apart.

The clamping device 3 further comprises a body member 19 having a flat face in contact with the plate 16 and having a groove 20 of part-circular cross-section in which the lug 13 fits.

A clamping screw has an integral handle 21 at one end, and adjacent the handle, a collar 22. The clamping screw extends from the collar 22 in a direction away from the handle 21 through central bores in the plates 15 and 16 and in the body member 19 and thence through an arcuate slot 23 in the lug 13 into the bore 14. The bore 14 contains a short cylindrical rod 24 having a diametric tapped bore 25 into which the end of the clamping screw is screwed.

Thus by tightening the clamping screw by means of the handle 21, the plates 15 and 16, the body member 19 and part of the lug 13 are clamped between the collar 22 and the rod 24 and the tube 2 is clamped in the grooves 17 and 18. The workpiece clamp 1 is thus rigidly fixed to the tube 2.

On releasing the clamping screw by means of the handle 21, the clamping device 3 as a whole is able to slide longitudinally along the tube 2 and also to turn about the longitudinal axis of the tube 2 because the tube 2 is free to move in the grooves 17 and 18. The body member 19 which the workpiece clamp 1 is able to turn relative to the plates 15 and 16 about the axis of the clamping screw, which forms the second axis, which is perpendicular to the axis of the tube 2, and finally the lug 13 together with the workpiece clamp 1 can turn through a limited angle about the axis of the rod 24, which forms the third axis, that is the axis which is perpendicular to the axis of the clamping screw. As shown in FIG. 3, this third axis, that is the axis of the rod 24, is parallel to the axis of the tube 2, but this is not, of course, so when the clamp 1 and the body member 19 have been turned from the position shown in FIG. 3 relative to the plates 15 and 16 about the axis of the clamping screw. Once the workpiece clamp 1 has been set in any required position relative to the tube 2, the clamping screw is tightened again by means of the handle 21 so that the clamp 1 is locked in position relative to the tube 2.

Since in the example shown in FIG. 1, both of the workpiece clamps 1 have a very high degree of adjustability relative to the tube 2, the workpiece 5 can be set in practically any required position relative to the workbench 4.

However, still greater adjustability of the relative positions of the two workpiece clamps 1 is provided by the second example of the device shown in FIG. 2 owing to the ability to adjust the positions of the tubes 2*a* and 2*b* by means of the further clamping device 6.

The further clamping device 6 comprises four disc-like plates 26, 27, 28 and 29. The plates 26 and 27 have registering grooves similar to the grooves 17 and 18 and these grooves receive the tubes 2*a*. The other two plates 28 and 29 also have registering grooves similar to the grooves 17 and 18 and these grooves receive the tube 2*b*.

A clamping screw having an integral handle 30 and a collar 31 similar to the handle 21 and the collar 22 extends freely through central bores in the plates 27 to 29 and is screwed into a tapped central bore in the plate 26.

Thus, in the same way as the tube 2 is clamped between the plates 15 and 16, the tubes 2*a* and 2*b* are clamped between the plates 26 and 27 and the plates 28 and 29 respectively when the clamping screw is tightened by the handle 30 and are freed when the clamping screw is released. When the clamping screw is released, the plates 26 and 27 can turn about the axis of the clamping screw relative to the plates 28 and 29 and accordingly the tubes 2*a* and 2*b* can swing about the axis of the clamping screw relative to each other. Both pairs of plates are also, of course, able to turn about the axes of the tubes which are clamped between them and also to slide along these tubes.

I claim:

1. In a device for holding two workpieces in relative positions which can be varied and for holding a single workpiece from a support in a spatial position which can be varied, said device comprising first and second workpiece clamps, each of said clamps being arranged to hold a workpiece of to be fixed to a support, an elongate cylindrical member and a clamping device for mounting each of said first and second clamps to said cylindrical member, said clamping devices allowing said first and second clamps to be adjusted in a position along a longitudinal axis of said cylindrical member; to be adjusted in an angular position around said longitudinal axis and also to be adjusted in an angular position about a second axis which is perpendicular to said longitudinal axis and about a third axis which is perpendicular to said second axis, the improvement wherein each of said clamping devices by which said first and second clamps are mounted on said elongate member includes a single clamping screw for operating said clamping device, two plates arranged face to face, means defining registering grooves in said two plates, said elongate member being held in said grooves, a body member and pivot means attaching said body member to said workpiece clamp, said clamping screw passing through said plates and through said body member to said pivotal means and being arranged so that, when tightened, it clamps the said plates together with said elongate cylindrical member between said plates and also clamps said plates to said body member and clamps the said pivot means against movement, and, when loosened, allows said plates to turn relative to said elongate cylindrical member about the axis thereof; allows said plates to turn relative to said body member about the axis of said clamping screw, which forms said second axis; and frees said pivot means to allow said workpiece clamp to pivot relative to said body member about an axis, which forms said third axis, perpendicular to the axis of said clamping screw.

2. A device as claimed in claim 1, in which said first and second workpiece clamps are adjustably mounted on one and the same elongate cylindrical member.

3. A device as claimed in claim 1, in which said first workpiece clamp is mounted on a first elongate cylindrical member and said second workpiece clamp mounted on a second elongate cylindrical member, and further comprising an additional clamping device adjustably fixing said first and second elongate cylindrical members to each other in relative positions which can be varied along the longitudinal axis of said first and second elongate members and can also be varied angularly about said longitudinal axes of said first and second elongate cylindrical members and about an axis perpendicular to said longitudinal axes of said two elongate cylindrical members.

4. A device as claimed in claim 1 in which said elongate member. is a metal tube.

5. A device as claimed in claim 3, in which said first and second cylindrical members are both metal tubes.

6. A device as claimed in claim 1, in which said pivot means comprises a tubular portion of said workpiece clamp, said tubular portion including means defining an arcuate slot in said tubular portion, said clamping screw passing through said arcuate slot, and a cylindrical piece which fits. and is rotatable, in said tubular portion, said cylindrical piece having means defining a tapped diametric bore therethrough into which said clamping screw is screwed.

7. A device as claimed in claim 3, in which said device by which said first and second elongate cylindrical members are detachably fixed together comprises a first pair of plates and a second pair of plates, a clamping screw clamping said first and second pairs of plates together, means defining a first pair of registering grooves in said first pair of plates, and first elongate cylindrical member being held in said first pair of registering grooves, means defining a second pair of registering grooves in said second pair of plates, said second elongate cylindrical member being held in said second pair of registering grooves; and, when said clamping screw is released, said first pair of plates being rotatable about the axis of said clamping screw relative to said second pair of plates, said first pair of plates being rotatable about the axis of, and slidable along said first elongate cylindrical member and said second pair of plates being rotatable about the axis of, and slidable along said second elongate cylindrical member.

* * * * *